US006919690B2

(12) United States Patent
Siegfried et al.

(10) Patent No.: US 6,919,690 B2
(45) Date of Patent: Jul. 19, 2005

(54) MODULAR UNIFORM GAS DISTRIBUTION SYSTEM IN AN ION SOURCE

(75) Inventors: Daniel E. Siegfried, Fort Collins, CO (US); David Matthew Burtner, Fort Collins, CO (US); Scott A. Townsend, Fort Collins, CO (US); John Keem, Bloomfield Hills, MI (US); Mark Krivoruchko, Zelenograd (RU); Valery Alexeyev, Moscow (RU); Vsevolod Zelenkov, Moscow (RU)

(73) Assignee: Veeco Instruments, Inc., Woodbury, NY (US)

( * ) Notice: Subject to any disclaimer, the term of this patent is extended or adjusted under 35 U.S.C. 154(b) by 0 days.

(21) Appl. No.: 10/896,747

(22) Filed: Jul. 21, 2004

(65) Prior Publication Data

US 2005/0045035 A1 Mar. 3, 2005

Related U.S. Application Data

(60) Provisional application No. 60/489,476, filed on Jul. 22, 2003.

(51) Int. Cl.[7] ..... H01J 7/24

(52) U.S. Cl. ..... 315/111.91; 156/345.33

(58) Field of Search ..... 315/111.81, 111.91; 156/345.33, 345.34; 250/423 R

(56) References Cited

U.S. PATENT DOCUMENTS 5,624,498 A * 4/1997 Lee et al. ..... 118/715
5,763,989 A 6/1998 Kaufman ..... 313/361.1
5,781,693 A * 7/1998 Ballance et al. ..... 392/416
6,002,208 A 12/1999 Maishev ..... 315/111.91
6,037,717 A 3/2000 Maishev ..... 315/111.91

(Continued)

OTHER PUBLICATIONS

Dr. John Keem, High Current Density Anode Layer Ion Sources, 44th Annual Technical Conference Proceedings, 2001, pp. 1–6, Society of Vacuum Coaters.

(Continued)

*Primary Examiner*—Thuy V. Tran
(74) *Attorney, Agent, or Firm*—Hensley, Kim & Edgington, LLC

(57) ABSTRACT

A modular ion source design relies on relatively short modular anode layer source (ALS) components, which can be coupled together to form a longer ALS. For long ion sources, these shorter modular components allow for easier manufacturing and further result in a final assembly having better precision (e.g., a uniform gap dimensions along the longitudinal axis of the ion source). Modular components may be designed to have common characteristics so as to allow use of these components in ion sources of varying sizes. A modular gas distribution system uniformly distributes a working gas to the ionization region of the module ion source. For each gas distribution module, gas distribution channels and baffles are laid out relative to the module joints to prevent gas leakage. Furthermore, gas manifolds and supply channels are used to bridge module joints while uniformly distributing the working gas to the ALS.

22 Claims, 8 Drawing Sheets

U.S. PATENT DOCUMENTS

| | | | | |
|---|---|---|---|---|
| 6,130,507 | A | 10/2000 | Maishev | 315/111.81 |
| 6,147,354 | A | 11/2000 | Maishev | 250/423 R |
| 6,153,067 | A | 11/2000 | Maishev | 204/298.04 |
| 6,214,183 | B1 | 4/2001 | Maishev | 204/298.04 |
| 6,236,163 | B1 | 5/2001 | Maishev | 315/111.81 |
| 6,238,526 | B1 | 5/2001 | Maishev | 204/192.11 |
| 6,242,749 | B1 | 6/2001 | Maishev | 250/423 R |
| 6,246,059 | B1 | 6/2001 | Maishev | 250/426 |
| 6,250,250 | B1 | 6/2001 | Maishev | 118/723 R |
| 6,359,388 | B1 | 3/2002 | Petrmichl | 315/111.81 |
| 6,368,664 | B1 | 4/2002 | Veerasamy et al. | 345/428 |
| 6,454,901 | B1 | 9/2002 | Sekiya et al. | 162/111 |
| 6,454,910 | B1 | 9/2002 | Zhurin et al. | 204/192.12 |
| 6,537,418 | B1 * | 3/2003 | Muller et al. | 156/345.34 |
| 6,612,105 | B1 * | 9/2003 | Voigt et al. | 60/202 |
| 6,645,301 | B2 * | 11/2003 | Sainty | 118/665 |
| 6,777,030 | B2 | 8/2004 | Veerasamy et al. | 427/249.7 |
| 6,808,606 | B2 | 10/2004 | Thomsen et al. | 204/192.3 |
| 6,815,690 | B2 * | 11/2004 | Veerasamy et al. | 250/423 R |
| 6,849,854 | B2 * | 2/2005 | Sainty | 250/423 R |

OTHER PUBLICATIONS

D. Burtner, Linear Anode–Layer Ion Sources With 340– and 1500–mm Beams, 46th Annual Technical Conference Proceedings, May 2003, pp. 61–66, Society of Vacuum Coaters.

V. Dudnikov, Ion Source With Closed Drift Anode Layer Plasma Acceleration, Review of Scientific Instruments, Feb. 2002, pp. 729–731, vol. 73 No. 2, American Institute of Physics.

V. Zhurin, Physics of Closed Drift Thrusters, Plasma Sources Sci. Technol. 8, 1999, pp. R1–R20, IOP Publishing Ltd., UK.

N. Vershinin, Hall Current Accelerator For Pre–Treatment of Large Area Glass Sheets, Coatings on Glass, 1999, pp. 283–286.

V. Baranov, Energy Model and Mechanisms of Acceleration Layer Formation For Hall Thrusters, 33rd Joint Propulsion Conference, Jul. 1997, pp. 1–8, AIAA 97–3047, Reston, VA.

A. Zharinov, Acceleration of Plasma by a Closed Hall Current, Soviet Physics—Technical Physics, Aug. 1967, pp. 208–211, vol. 12 No. 2, Russia.

A. Semenkin, Investigation of Erosion in Anode Layer Thrusters and Elaboration High Life Design Scheme, 23rd Intl Electric Propulsion Conf., Sep. 1993, pp. 1–6, IEPC–93–231.

L. Lou, Application Note: Ion Source Precleaning, Advanced Energy, Mar. 2001, pp. 1–4, Fort Collins, CO.

Plasma Surface Engineering Corporation, Compound Ion Beam–Magnetron Sputtering Source, Product Specification: I–Mag, Feb. 2003, pp. 1–5, San Diego, CA.

A. Shabalin, Whitepaper: Industrial Ion Sources and Their Application for DLC Coating, SVC 42nd Annual Technical Conference, Jan. 2001, pp. 1–4, Fort Collins, CO.

Advanced Energy, Ion Beam Sources, [online], Aug. 2002, [retrieved on Dec. 6, 2004], Retrieved from the Advanced Energy company website using Internet <URL: http://www.advanced–energy.com/upload/sl–ion–230–02.pdf>, pp. 1–6, Fort Collins, CO.

Vecor, Vacuum Equipment Coatings and Optics from Russia, [online], last updated on Apr. 22, 2004, [retrieved on Dec. 6, 2004], Retrieved from the Advanced Energy company website using Internet <URL: http://www.vecorus.com/welcom.htm>, Moscow, Russia.

Vecor, Vacuum Equipment Coatings and Optics from Russia, Magnetrons Ion Sources and Accessories, [online], last updated on Apr. 22, 2004, [retrieved on Dec. 6, 2004], Retrieved from the Advanced Energy company website using Internet <URL: http://www.vecorus.com/magionsource.htm>, Moscow, Russia.

* cited by examiner

MODULAR UNIFORM GAS DISTRIBUTION SYSTEM IN AN ION SOURCE

RELATED APPLICATIONS

This application claims benefit of U.S. Provisional Application No. 60/489,476 entitled "Modular Anode Layer Source having a Flexible Anode" and filed on Jul. 22, 2003, incorporated herein by reference for all that it discloses and teaches.

In addition, this application relates to U.S. patent application Ser. No. 10/896,745 entitled "Longitudinal Cathode Expansion in an Ion Source" and U.S. patent application Ser. No. 10/896,746 entitled "Modular Ion Source", both filed on Jul. 21, 2004 and incorporated herein by reference for all that they disclose and teach.

TECHNICAL FIELD

The invention relates generally to ion sources, and more particularly to a modular uniform gas distribution system in an ion source.

BACKGROUND

Anode Layer Sources (ALSs) produce and accelerate ions from a thin and intense plasma called the "anode layer". This anode layer forms adjacent to an anode surface of an ALS due to large Hall currents, which are generated by the interaction of strong crossed electric and magnetic fields in the plasma discharge (gap) region. This plasma discharge region is defined by the magnetic field gap between cathode pole pieces (also called the "cathode-cathode gap") and the electric field gap between the downstream surface of the anode and the upstream surface of the cathode (also called the "anode-cathode gap"). A working gas, including without limitation a noble gas, oxygen, or nitrogen, is injected into the plasma discharge region and ionized to form the plasma. The electric field accelerates the ions away from the plasma discharge region toward a substrate.

In one implementation of a linear ALS, the anode layer forms a continuous, closed path exposed along a race-track-shaped ionization channel in the face of the ion source. Ions from the plasma are accelerated primarily in a direction normal to the anode surface, such that they form an ion beam directed roughly perpendicular to the ionization channel and the face of the ion source. Different ionization channel shapes may also be employed.

For typical etching or surface modification processes, a substrate (such as a sheet of flat glass) is translated through the ion beam in a direction perpendicular to the longer, straight sections of the ionization channel. Uniform etching across the substrate, therefore, depends on the ion beam flux and energy density being uniform along the length of these straight channel sections. Variations in the ion beam flux and energy density uniformity along the straight channel sections can significantly degrade the longitudinal uniformity of the resulting ion beam.

Non-uniformities in the anode-cathode gap can have a significant negative effect on the longitudinal ion beam uniformity and can be introduced in various ways during manufacturing. For example, the ion source body can be warped by the welding or brazing of a cooling tube to the outside surface of the ion source body, thus introducing anode-cathode gap variations.

Minor gap variations can result in substantial longitudinal beam current density variations. A typical ALS geometry has an anode-cathode gap of 2 mm, a cathode-cathode gap of 2 mm, and a cathode face height of 2 mm, which is also known as a 2×2×2 mm geometry. Measurements of a linear ALS using this geometry have shown that variations of 0.3 mm in the anode-cathode gap dimension can cause longitudinal beam current density variations of 8%. It should be understood that alternative ALS configurations and dimensions may also be employed. Non-uniformities in the cathode-cathode gap and the working gas distribution to the anode layer can also negatively influence ion beam uniformity.

A typical ALS design includes a rigid monolithic anode supported on insulators in a cavity of a rigid monolithic source body. Both the anode and the source body are cut from stainless steel stock and are precisely machined to the desired dimensions. Rough machining and welding-induced or brazing-induced distortion during assembly often dictate that the flat surfaces of the source body and anode undergo a final precision machining operation in order to hold the desired gap dimension tolerance.

This manufacturing process has provided good results for relatively short ion sources (e.g., 300 mm long). However, some ALS applications can require very long ion sources (e.g., 2540 mm to 3210 mm). For example, some architectural glass processing applications can require an ALS that is about twelve feet long (i.e., 3657.6 mm). Such length can make it extremely difficult and prohibitively expensive to maintain the required uniformity of the anode-cathode gap over the entire length of the ALS. Therefore, using traditional monolithic designs and manufacturing techniques for long ALSs is undesirable and potentially infeasible.

In addition, to effect a more uniform ion beam along the length of the ALS, the working gas is distributed uniformly throughout the ion source to the longitudinal sections of the anode-cathode gap. Traditional monolithic ion sources generally employ a gas distribution component that runs the working gas through channels that run the full length of the ALS. However, this approach is not suitable for a non-monolithic ion source assembly.

SUMMARY

Implementations described and claimed herein address the foregoing problems by providing a modular ion source design and modular ion source manufacturing techniques. The modular ion source design relies on relatively short modular core ALS components, which can be coupled together to form a longer ALS while maintaining an acceptable tolerance of the anode-cathode gap. For long ion sources, these shorter modular components allow manufacturing methods that are more feasible and less expensive than the monolithic approaches and further result in a final assembly having better precision (e.g., uniform gap dimensions along the longitudinal axis of the ion source). Many of the modular components may be designed to have common characteristics so as to allow use of these components in ion sources of varying sizes.

Modularity in the working gas distribution system of the ALS presents challenges in distributing the gas at a controlled pressure uniformly over the length of the ALS. As such, for each gas distribution module, gas distribution channels and baffles are laid out relative to the module joints to prevent gas leakage. Furthermore, gas manifolds and supply channels are used to bridge module joints while uniformly distributing the working gas to the ALS.

In an exemplary implementation, a method is provided that assembles a gas distribution system of an ion source. Multiple gas distribution plate modules are assembled into a gas distribution plate mounted to a source body of the ion source. A gas entry manifold is mounted at a joint between at least two of the gas distribution plate modules to distribute working gas to each of the distribution plate modules.

In another exemplary implementation, a gas distribution system is provided for an ion source having an anode, a cathode, and a source body forming a cavity containing the anode and supporting the cathode. Multiple gas distribution plate modules form a modular gas distribution plate for supplying a working gas to the ion source. Each gas distribution plate module includes a bifurcated distribution tree of gas distribution channels formed therein.

In another exemplary implementation, an ion source includes an anode, a cathode, and a source body forming a cavity containing the anode and supporting the cathode. Multiple gas distribution plate modules form a modular gas distribution plate for supplying a working gas to the ion source. Each gas distribution plate module includes a bifurcated distribution tree of gas distribution channels formed therein.

Other implementations are also described and recited herein.

BRIEF DESCRIPTIONS OF THE DRAWINGS

DETAILED DESCRIPTIONS

Figure 1:
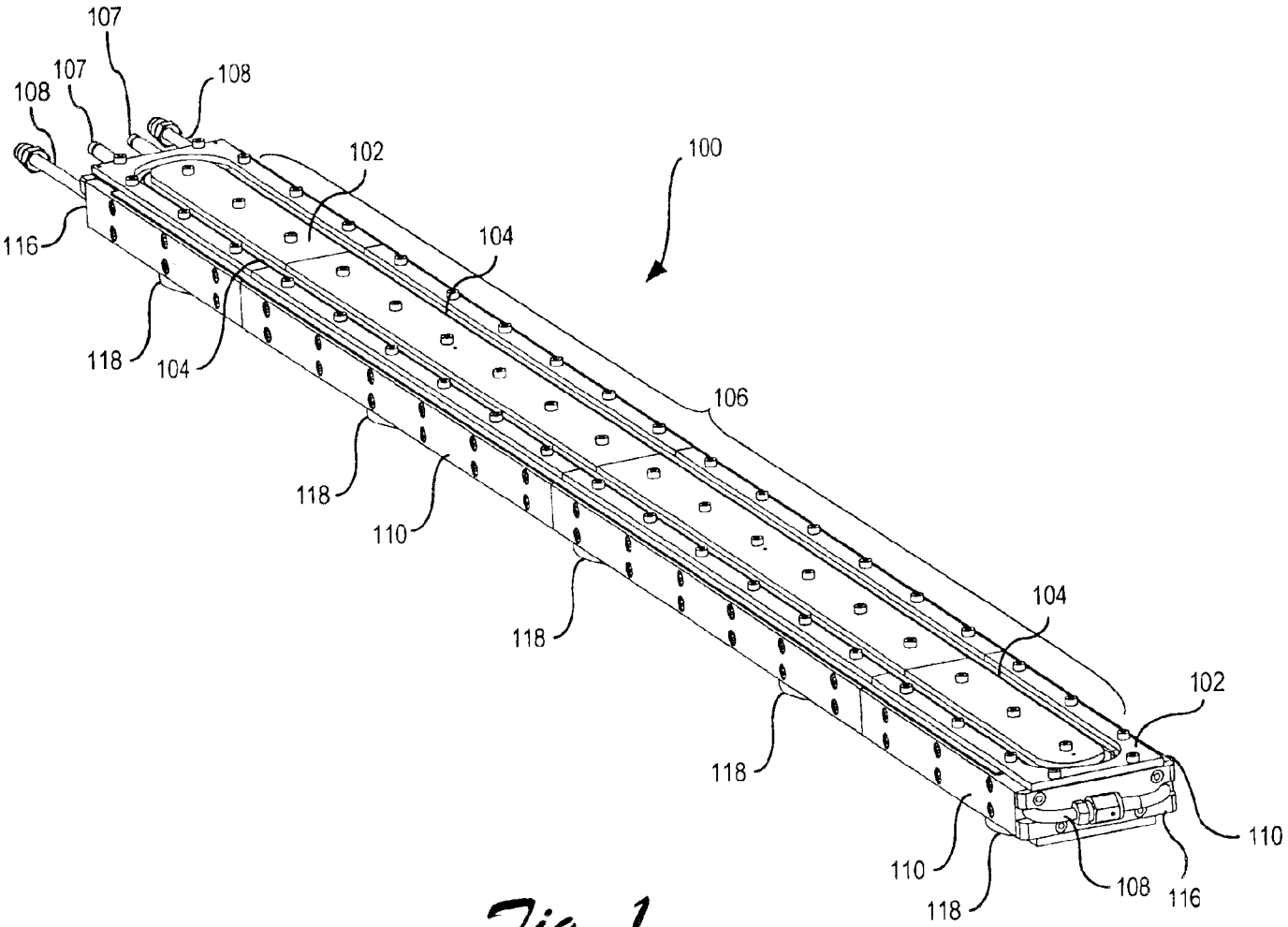
FIG. 1 illustrates an exemplary modular ALS.

FIG. 1 illustrates an exemplary modular ALS 100. Cathode covers 102 are affixed to the ALS 100 to form an opening for a race-track-shaped ionization channel 104. The cathode covers 102 may be monolithic or modular, although the illustrated implementation employs modular cathode covers.

The anode and the cathode of the ALS 100 are located below the cathode covers 102. In one implementation, the anode is tied to a high positive potential and the cathode is tied to ground in order to generate the electric field in the anode-cathode gap, although other configurations of equivalent polarity may be employed. A magnetic circuit is established through the source body to the cathodes using magnets to form a magnetic field in the cathode-cathode gap. The interaction of strong crossed electric and magnetic fields in this gap region ionizes the working gas and accelerates the ions in an ion beam from the anode layer toward a target (e.g., toward a substrate). Generally, the substrate is passed through the ion beam perpendicular to the longitudinal section 106 of the ALS 100 so that each portion of the substrate receives a uniform dose from the ion beam.

The ALS 100 is manufactured from modular components. To facilitate use of common component modules in ion sources having different lengths, typical substrate widths for various ion beam applications were considered. Some typical substrate widths for web coating and flat glass applications are 1.0 m, 1.5 m, 2.54 m, and 3.21 m. As such, a common source body module length of 560 mm was determined to provide ion sources with suitable beam lengths to cover all of these sizes, in addition to covering a 2.0 m ion source. However, it should be understood that different module lengths may also be employed, and in some applications, the modules lengths may differ substantially within the same modular ion source.

The source body modules are bound together by the clamp plates 110 and other structures in the ALS 100 so as to provide overall rigidity along the length of the ALS 100 (i.e., along the longitudinal axis of the ion source). In addition, a flexible anode, which is less rigid than a traditional rigid monolithic anode, is sufficiently flexible to allow the anode to follow any discontinuities or warpage along the length of the ALS 100, thereby contributing to the uniformity of an anode-cathode gap. End plates 116 close off each end of the ALS 100.

The plasma and the high voltage used to bias the anode of the ALS 100 generate a large amount of heat, which can damage the ion source and undermine the operation of the source. Accordingly, the anode is cooled by a coolant (e.g., water) pumped through a hollow cavity within the anode by cooling tubes 107. Furthermore, a cooling tube 108 assists in cooling the cathode and source body of the ALS 100 by conducting the heat away from the ion source body through a coolant (e.g., water), which is pumped through the cooling tube 108. The cooling tube 108 may be constructed from various materials, including without limitation stainless steel, copper, or mild steel. The clamp plates 110 press the cooling tube 108 against the side of the body of the ALS 100 to provide the thermally conductive contact for cooling the source, without the need for welding or brazing of the cooling tube 108 to the ion source body. In at least one implementation, the clamp plates 110 overlap the joints between ion source body modules to provide structural rigidity and alignment force along the length of the ALS 100.

In one implementation, an easily compressible material with high conductivity (such as indium foil) is compressed between the cooling tube 108 and the source body. The material conforms between the source body and the cooling tube 108 to improve heat conduction from the body of the ALS 100 to the coolant, although other heat conducting materials may also be employed, such as flexible graphite.

Alternatively, no added material is required between the cooling tube 108 and the source body. In one implementation, grooves in the source body and the clamp plates 110 are sized to compress the cooling tube 108 with enough force to cold work or deform the tube 108 against the source body, thereby providing an adequate thermally conductive contact to effectively cool the source body and the cathode.

The working gas is distributed uniformly through the ALS 100 to the longitudinal sections 106 of the anode-cathode gap in order to effect a uniform plasma and, therefore, a uniform ion beam along the length of the ALS 100. In one implementation, gas manifolds are mounted to a modular gas distribution plate at the bottom of the ALS 100 (e.g., see manifolds 118). The gas manifolds inject the working gas into the gas distribution plate, which distributes the working gas evenly to a gas baffle plate. The working gas then flows from the gas baffle plate through injection holes in the source body to the anode, where it is ionized. The use of the gas manifolds facilitates uniform gas distribution through multiple gas distribution plate modules along the length of the ALS 100.

In some implementations, gas distribution to the gas distribution plate may be regulated to be non-uniform to account for non-uniform conditions in the operating environment (e.g., a non-uniform vacuum). The non-uniform flow to the gas distribution plate can compensate for a non-uniform vacuum to yield a uniform gas distribution at the anode in the source body of the ion source.

The gas manifolds can perform a variety of functions. An exemplary gas manifold, called a gas entry manifold, usually bridges a joint between two gas distribution plate modules, distributing the working gas evenly between the two modules. Another exemplary gas manifold is called a gas feeder manifold, which receives the working gas though a supply channel within a gas distribution plate module and distributes the working gas into a bifurcated tree of gas distribution channels within the module. Yet another exemplary gas manifold is called an end manifold, which bridges the joint between a longitudinal gas distribution plate module located in the linear section of the ALS 100 and an end module of the modular gas distribution plate located in the non-linear end section of the ALS 100. (See the discussion regarding FIG. 3).

Figure 2:
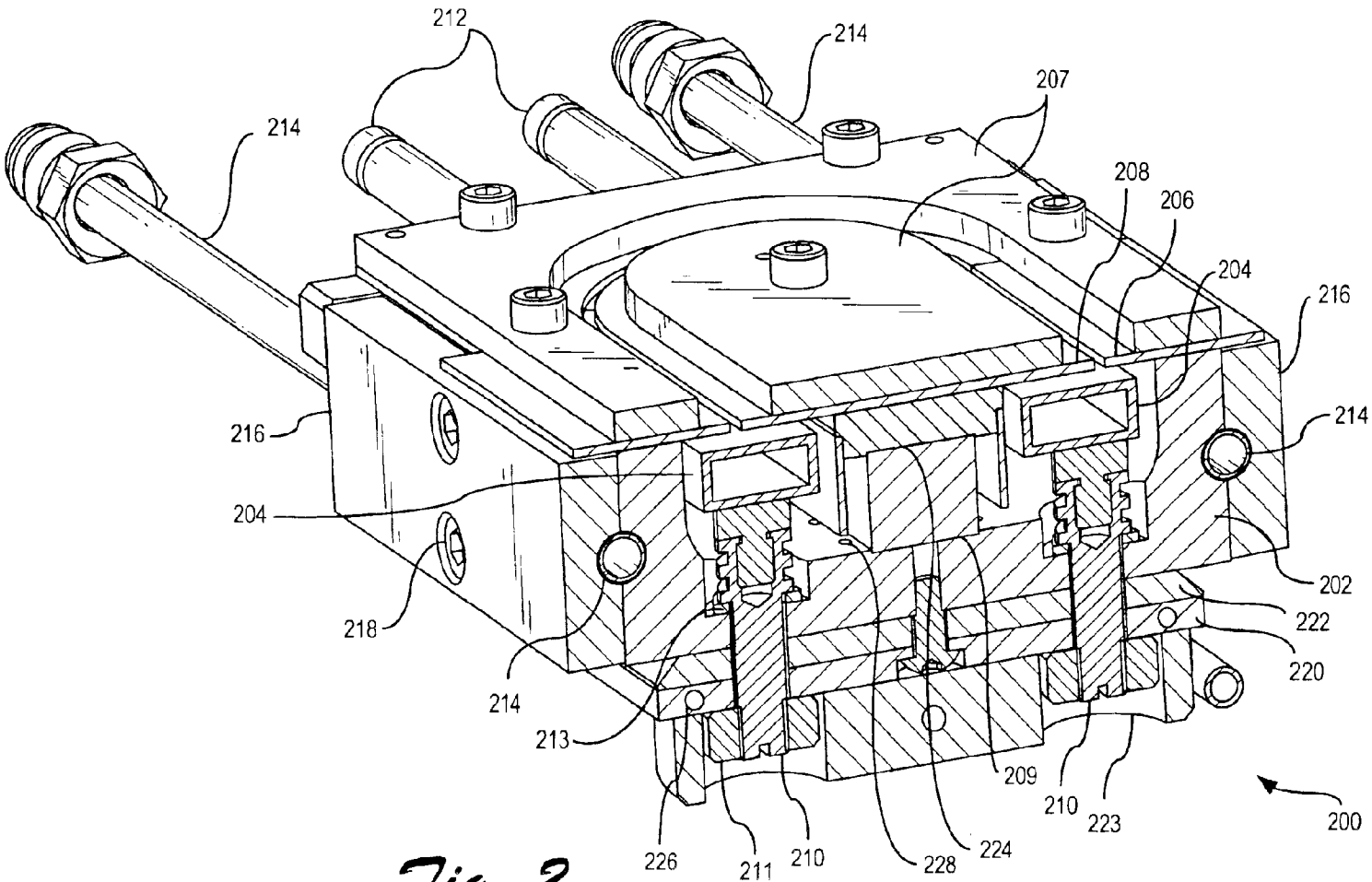
FIG. 2 illustrates a cross-sectional view of an exemplary modular ALS.

FIG. 2 illustrates a cross-sectional view of an exemplary modular ALS 200. An end module of an ion source body 202 of the ALS's body forms a roughly U-shaped cavity in which the anode 204 is located. Additional source body modules (not shown) extend the cavity down the length of the ALS 200.

The two cathode plates 206 and 208 form the cathode of the ALS. The separation between the cathode plates 206 and 208 establishes the cathode-cathode gap around the race-track-shaped ionization channel. A magnetic circuit is driven by a magnet 209, through the source body module 202, to each of the cathode plates 206 and 208. Cathode covers 207 clamp the cathode plates 206 and 208 to the source body module 202 and magnet covers 224, and define an opening for the race-track-shaped ionization channel.

As shown in FIG. 2, the anode 204 is fabricated from a thin-walled stainless steel tubing in order to provide the desired flexibility along the anode's length. Tubing sections are welded together to form a rectangular-shaped anode that lies under the opening at the ionization channel. In one implementation, the tubing is commercially available 300 series thin walled rectangular tubing (0.375"×0.75"×0.060" wall), although other specifications and dimensions are also contemplated, including tubing with a height of 0.125 "–0.5", a width of 0.5"–1.0", and a wall thickness of 0.02"–0.09". Accordingly, the anode 204 is comparatively flexible in the Y-axis (i.e., the ion beam axis), so it will easily conform to irregularities along the source body. Furthermore, the tubing walls are thick enough to prevent "ballooning" of the tubing during operation and to prevent overall distortion of the anode's rectangular shape.

The anode 204 is mounted to a series of anode insulator posts 210, which supports the anode 204 at the proper height to achieve the desired uniform anode-cathode gap dimension. The insulator posts 210 are spaced close enough together (e.g., ~<200 mm) along the anode 204 to prevent sagging or distortion of the anode 204. The insulator posts 210 are fixed in place during operation by insulator nuts 211 and precision machined spacers 213. (Note: In some implementations, spacers are not employed because the other components are precision machined to achieve the desired anode-cathode gap dimension.) The anode insulator posts 210 may have a fixed height relative to the interior surface of the source body module 202 or the height of the posts 210 can be changed during manufacturing to adjust the anode-cathode gap to within a specified tolerance along the length of the ALS 200. Where the posts 210 are adjustable, they are generally fixed after manufacture and during operation.

The anode 204 includes a hollow conduit to allow the flow of anode coolant (e.g., water) provided by anode cooling tubes 212. Another cooling tube 214 is clamped to the source body module 202, as well as the other source body modules in the ALS 200, to provide additional cooling capacity to the source body module 202 and the cathode 206/208. The cooling tube 214 is pressed into thermally conductive contact with the source body modules by clamp plates 216 and clamp screws 218.

A working gas, which is ionized to produce the plasma, is distributed under uniform controlled pressure within the cavity of the source body module 202. A modular gas distribution plate 220, in combination with gas distribution manifolds (such as manifold 223), uniformly distributes the gas into a gas baffle plate 222, which directs the gas through flow holes 228 in the source body module 202. The modular gas distribution plate 220 also includes precision drilled pin holes 226 to facilitate alignment of adjacent modular gas distribution plates and channels along the length of the ALS 200.

Figure 3:
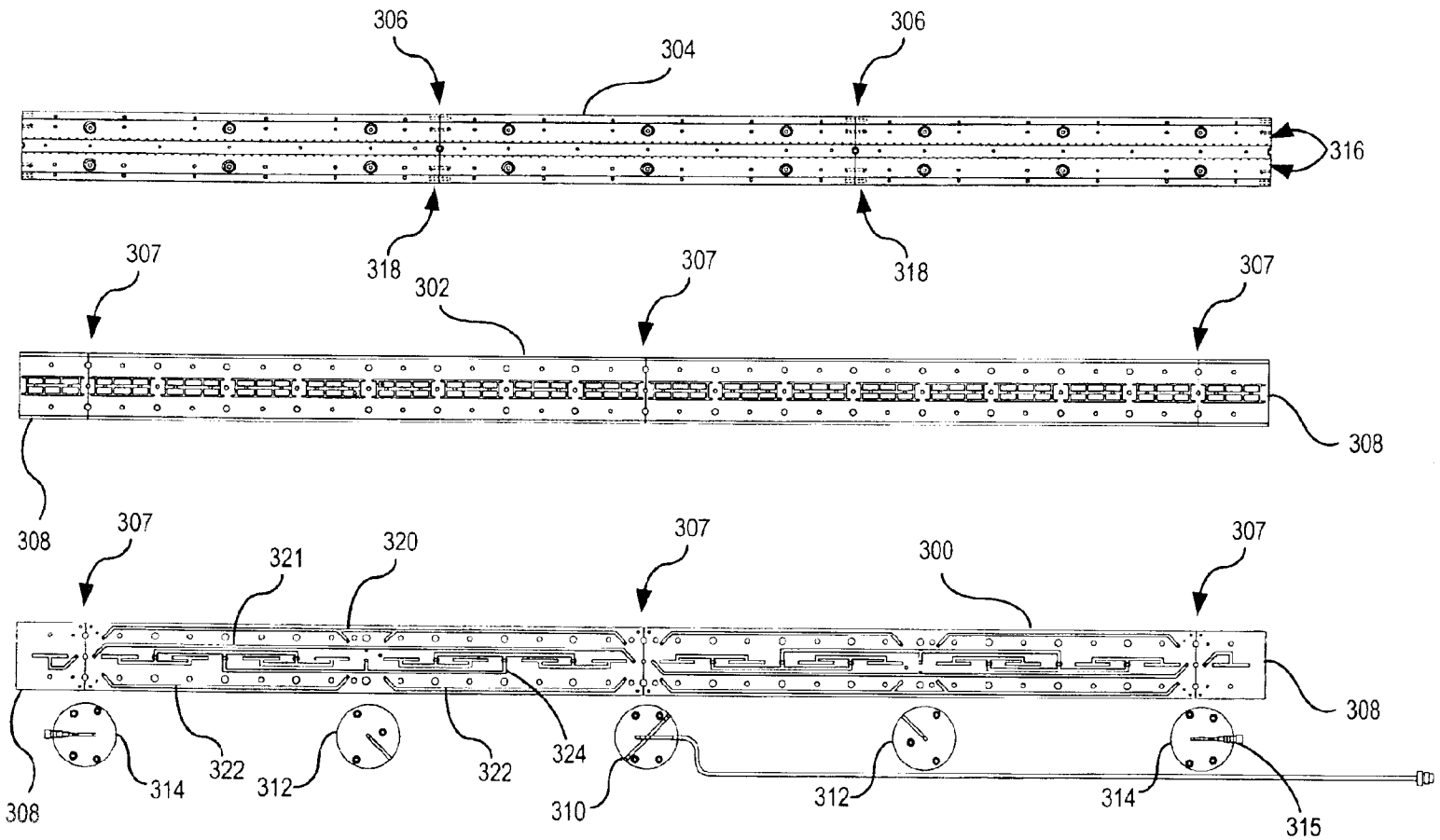
FIG. 3 illustrates exemplary modules of a gas distribution plate, a corresponding gas baffle plate, and a source body for a modular ALS.

FIG. 3 illustrates exemplary modules of a gas distribution plate, a corresponding gas baffle plate, and a source body for a modular ALS. Joints between component source body modules are shown at 306, and the joints between gas distribution plate and gas baffle plate modules are shown at 307. The various modules are joined into a sealed pressure fit by virtue of the overlapping plates and screws used in assembly. It should also be noted that the gas distribution plate 300 and the gas baffle plate 302 include end modules 308 to offset their joints relative to the joints of the modular source body 304, thereby providing overlapping support across the joints of the modular source body 304 and improving the overall rigidity of the modular ion source. In addition, alternative modular configurations may be employed.

The illustrated source body joint modules are aligned using pins 318. The pins 318 are inserted into precision drilled holes in the joint edge surfaces of the source body modules. When the modular ion source is assembled, the source body modules are pressed tightly together by the supporting plates, including in some implementations, the clamping plates, the gas distribution and baffle plates, the cathode plates, and the cathode covers. The source body modules are aligned by pins 318 inserted into precision drilled holes in the joint surfaces of the source body modules, which force the adjacent source body modules into alignment along the shared pins. This alignment assists the maintenance of a uniform anode-cathode gap along the length of the modular ion source. Pins (not shown) may also be used in a similar fashion to align the gas distribution plate modules along the length of the modular ion source. The pins also add structural integrity to the source body and the gas plate joints.

The illustrated gas distribution system employs a multiple branch bifurcated gas distribution plate 300 having precisely milled channels that uniformly feed the working gas to the gas baffle plate 302. The gas distribution channels of the gas distribution plate 300 are designed to have an equal number of turns covering the same distance at each level of the bifurcated distribution hierarchy in order to distribute the working gas uniformly over the length of the modular ion source. The gas distribution plate 300 feeds the working gas into the gas baffle plate 302. The gas baffle plate 302 forms a plenum with precisely milled passages that is filled with pressured working gas. The gas baffle plate 302 feeds the working gas to the cavity of the source body 304 behind the anode through gas injection holes in the source body, such as holes 316.

In contrast to traditional monolithic ion sources, the bifurcated distribution tree shown in FIG. 3 is apportioned into modular sections. Individual gas plate modules may be keyed at their joints to help avoid incorrect assembly, which can result in hard-to-find gas blockages.

The modular sections may be used in the modular ion source designs described herein to create modular ion sources of various lengths (e.g., common ALS lengths used in industry include sources with overall lengths of 1.0, 1.5, 2.0, 2.54, and 3.21 m). In one implementation, each linear section module is produced in a length that is an appropriate multiple of a common ion source length (e.g., a multiple of the linear section length). In the illustrated implementation, the source body module sections are 560 mm long and the gas distribution plate and gas baffle plate sections are 746.413 mm long. Nevertheless, modules of various lengths could also be employed, even within the same ion source. Note that the gas distribution channel and baffle patterns are designed with a repeat length such that the milled gas channels and baffles do not cross module joints, thereby preventing gas leakage at the seam where two modules are joined.

Gas distribution manifolds, such as gas entry manifold 310, generally bridge the joint between two gas distribution plate modules to prevent gas leakage. Other gas distribution manifolds, such as gas feeder manifold 312, evenly distribute the working gas into the bifurcated distribution tree of each gas distribution plate module. In addition, other gas distribution manifolds, such as end manifold 314, distribute the working gas into the ends of the ion source through a control valve (such as a needle valve). The ends of an ion source generally exhibit different topologies and volumes as compared to a common linear interior module. Therefore, a control valve 315 allows the gas flow to be increased/decreased to control gas distribution to an end module of the gas distribution system, so as to result in uniform gas distribution to the anode. In an alternative embodiment, the gas feeder manifolds and gas entry manifolds may also include needle valves, such as when non-symmetrical gas input is needed to achieve uniform gas distribution to the plasma discharge region.

It should be understood that the illustrated manifolds are also designed to be easily used in different modular ion source configurations (e.g., employing a flexible port pattern in which various ports can be plugged or opened according the needed gas distribution configuration in the presence of a non-uniform operating vacuum. The manifolds may also be keyed (e.g., by designing distinct screw hole or pin hole configurations for different types of manifolds in order to prevent improper assembly, which could result in a gas blockage that would be difficult to troubleshoot).

Each gas distribution plate module in FIG. 3 includes longitudinal supply channels that connect to gas distribution manifolds positioned below the gas distribution plate 300. For example, a whole-module supply channel 320 can connect the end manifold 314, the feeder manifold 312, and the gas entry manifold 310. Another whole-module supply channel 321 is also shown. In contrast, a pair of half-length supply channels 322 can connect the end manifold 314 and the feeder manifold 312, and/or the feeder manifold 312 and the gas entry manifold 310. In addition to supply channels, each gas distribution plate module in FIG. 3 includes a set of bifurcated distribution tree channels, shown for one module at 324. Note that the bifurcation tree pattern and supply channel patterns are designed with a repeat length such that the milled gas channels do not cross module joints, thereby preventing gas leakage at the seam (or joint) where two modules are joined.

Depending on the length of the ion source, and therefore the gas distribution topology required for the given number of modules, individual ports of a manifold may or may not be open to a supply channel. That is, in some configurations, a port of a gas distribution manifold may be plugged to prevent the flow of gas from or to a given supply channel. As such, the channel topology and the combination of open/closed manifold ports can offer a variety of distribution schemes for different modular ion source configurations. Also, the number and spacing of gas injection holes in the various components are designed to accommodate the modular assembly of differently-sized ion sources.

Figure 4:
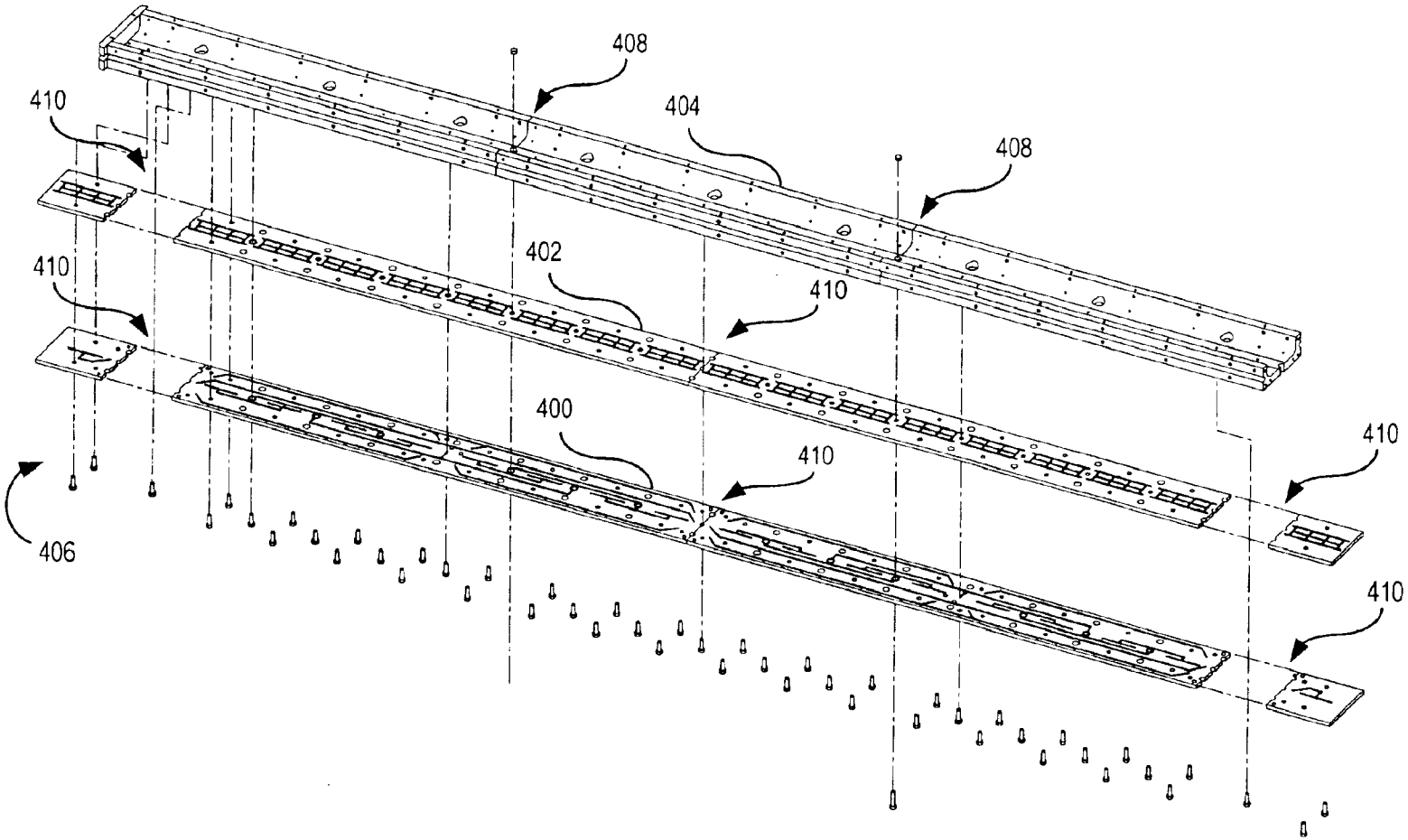
FIG. 4 illustrates an exploded assembly view of exemplary modules of a gas distribution plate, a corresponding gas baffle plate, and a source body for a modular ALS.

FIG. 4 illustrates an exploded assembly view of exemplary modules of a gas distribution plate 400, a corresponding gas baffle plate 402, and a source body 404 for a modular ALS. The three components are fastened together into a pressure sealed assembly, such as by the screws 406 shown in the illustrated implementation. In one implementation, the inter-module joints 408 of the source body 404 are offset relative to the inter-module joints 410 of the gas baffle plate 402 and the gas distribution plate 400 in order to provide enhanced rigidity to the modular ion source. However, alternative configurations are also contemplated.

Figure 5:
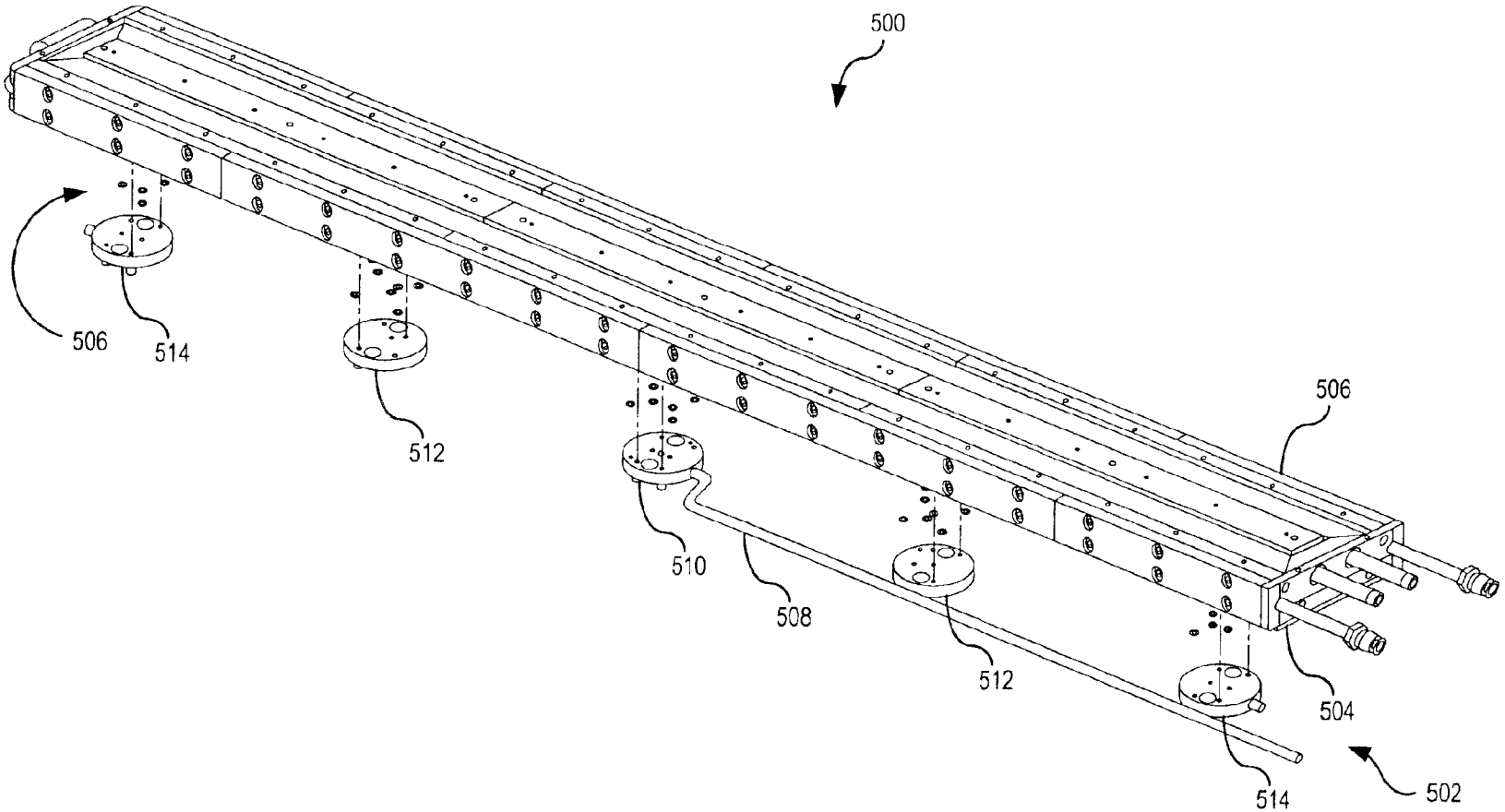
FIG. 5 illustrates an exploded assembly view of an exemplary modular ALS with corresponding gas distribution manifolds.

FIG. 5 illustrates an exploded assembly view of an exemplary modular ALS 500 with corresponding gas distribution manifolds 502. The manifolds 502 are screwed to the gas distribution plate 504 of the ALS assembly 506. In the illustrated implementation, a gas intake line 508 inputs the working gas into a gas entry manifold 510, which is positioned at a joint between two gas distribution plate modules. The gas entry manifold 510 distributes the working gas evenly between supply channels in the two gas distribution plate modules. The supply channels transport the working gas to two feeder manifolds 512, which distribute the working gas to a bifurcated distribution system within each gas distribution plate module.

Furthermore, the supply channels also transport the working gas to two end manifolds 514, which distribute the working gas into the end modules of the gas distribution plate 504. In the illustrated implementation, the end manifolds 514 are fitted with a needle valve, which can be adjusted to alter gas flow to the end modules of the gas distribution plate 504. This adjustment feature allows gas flow control to the ends of the ion source, which have a different topology and volume as compared to the linear sections of the ALS 500, to be adjusted to ensure the appropriate gas flow reaches the end modules of the gas distribution plate 504.

Figure 6A:
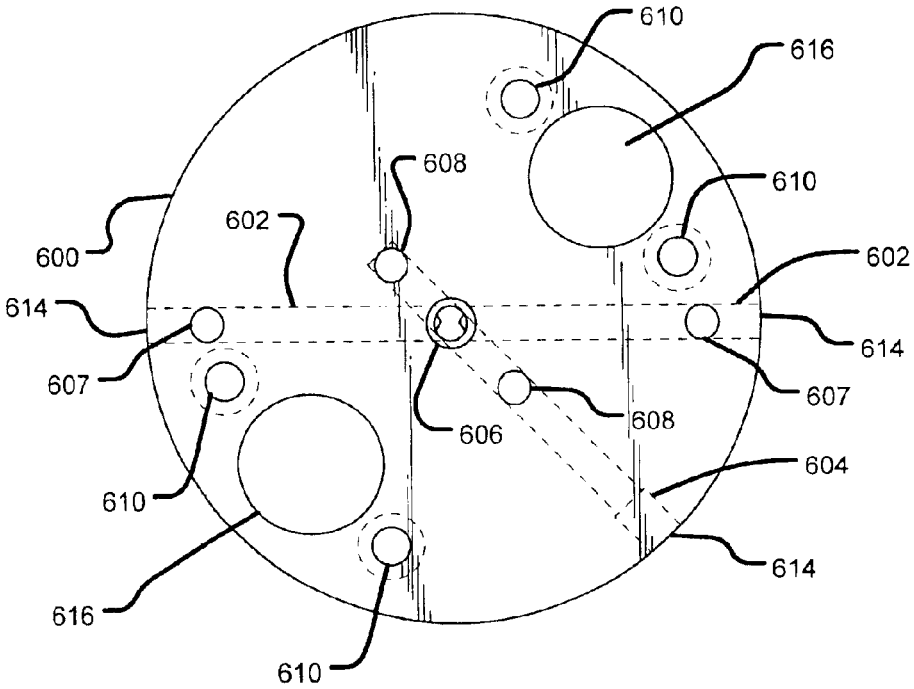
FIGS. 6A and 6B illustrates a top and perspective view of an exemplary gas distribution manifold for an exemplary modular ALS.
Figure 6B:
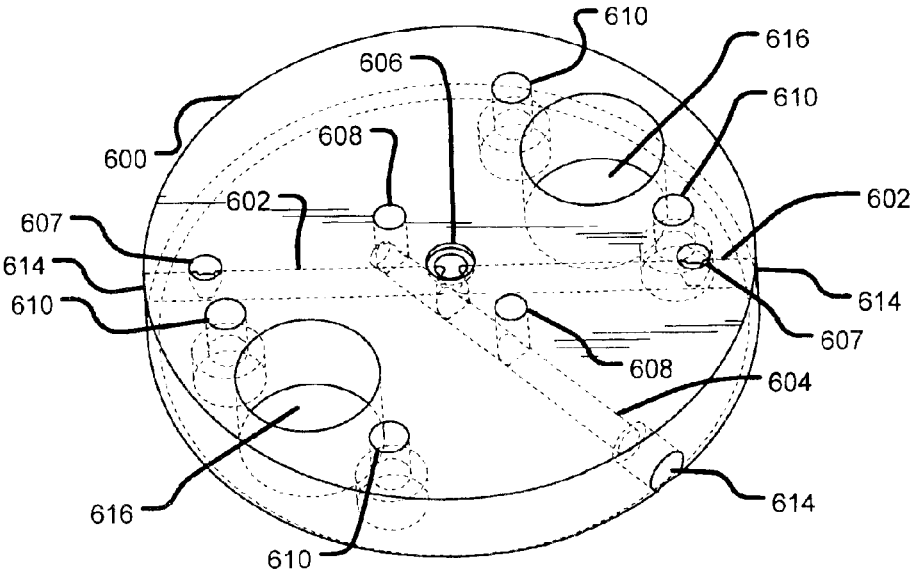

FIGS. 6A and 6B illustrate a top and perspective view of an exemplary gas distribution manifold 600 for an exemplary modular ALS. It should be understood, however, that many different configurations of gas distribution manifolds may be employed, even within the same ALS, in order to distribute the working gas within given ALS configurations (e.g., different lengths). A version of a gas entry manifold is shown in FIG. 6, but it should be understood that alternative configurations of a gas entry manifold, as well as other types of manifolds (including gas feeder manifolds and end manifolds) may be employed.

Manifold 600 includes two gas channels 602 and 604, which are joined at a junction 606. (A port located at junction 606 is plugged in the illustrated configuration, although, in other configurations, a different set of ports may be plugged.) The gas channel 602 vents to manifold ports 607, which supply the working gas into supply channels connected to gas feeder manifolds. Where no gas is required at a given manifold port, the port may be plugged. The gas channel 604 vents to manifold ports 608, which supply the working gas to supply channels connected to end manifolds. Ports may also receive working gas from a supply channel or any other channel in the gas distribution plate. In one implementation, ports are sealed with O-ring seals, although other sealing methods may be employed. In addition, to prevent incorrect placement of the different types of manifolds, each manifold type may be keyed by different screw hole layouts (see an exemplary screw hole 610).

Likewise, lateral ports 614 of the manifold 600, which open at the circumference of the manifold disk, may be open (e.g., so as to receive a gas intake line) or plugged. The large cylindrical holes 616 provide clearance for insulator nuts used to anchor the insulator posts supporting the anode when the manifold 600 is affixed to the ALS assembly. It should also be understood that the manifold 600 may be fitted with a needle valve to regulate gas flow to one or more sections of the gas distribution plate. (See, e.g., FIG. 7).

Figure 7:
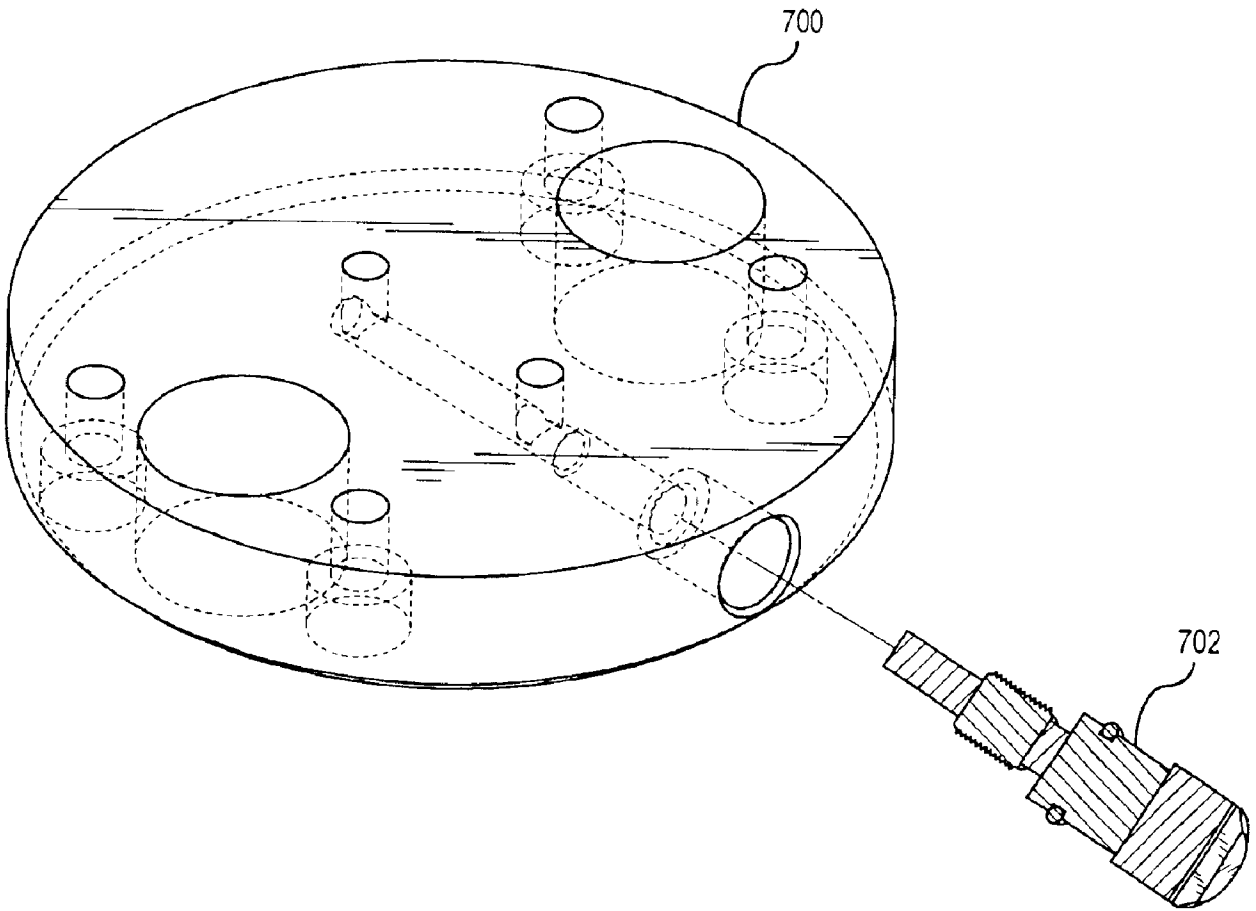
FIG. 7 illustrates an exemplary gas distribution manifold with and adjustable needle valve for an exemplary modular ALS.

FIG. 7 illustrates an exemplary gas distribution manifold 700 with an adjustable needle valve 702 for an exemplary modular ALS. Although in one implementation, a single needle valve is used in an end manifold to regulate the gas flow to an end module of a gas distribution manifold of a modular ALS, one or more needle valves may also be used in alternative implementations to regulate gas flow to interior modules of the gas distribution plate. This alternative implementation is particularly useful when the ion source operates in a chamber exhibiting uneven pressure along the length of the ion source. For example, needle valves can be adjusted in all of the manifolds on the ion source in order to produce non-uniform gas distribution to the gas distribution plate, which can result in uniform distribution to the anode in non-uniform operating environments (e.g., uneven vacuum pressures in the operating chamber).

Figure 8:
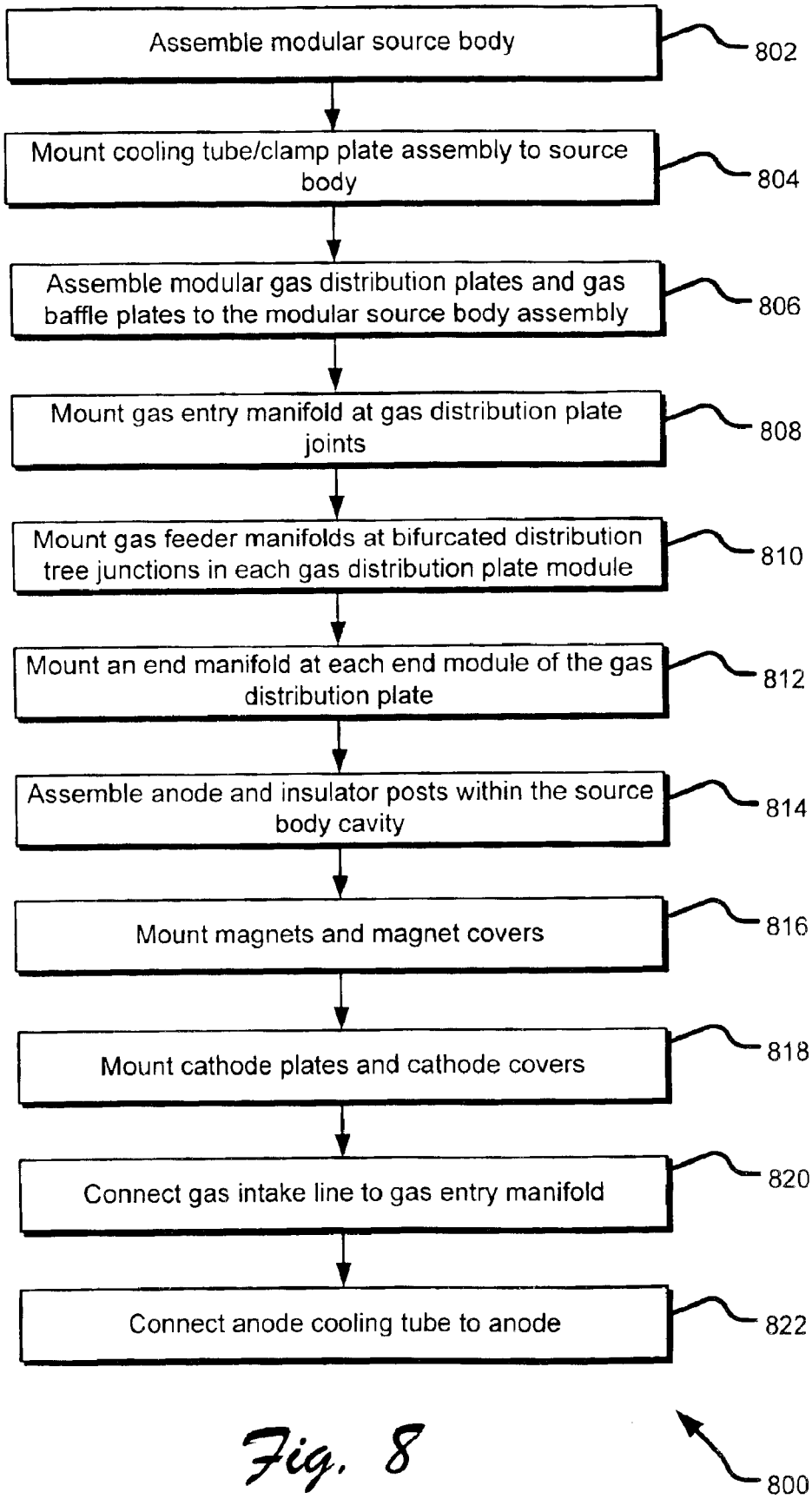
FIG. 8 illustrates exemplary operations for manufacturing a modular ALS providing uniform gas distribution.

FIG. 8 illustrates exemplary operations 800 for manufacturing a modular ALS providing uniform gas distribution. It should be understood that, unless explicitly limited to a specific order, each of these operations can be reordered in different implementations.

An assembly operation 802 assembles the modules of the source body into a modular source body assembly of a desired length. In one implementation, alignment pins are used to align the modules of the source body along the length of the modular ion source. A mounting operation 804 mounts a source body cooling tube and multiple clamp plates to the body of the ion source. In some implementations, the mounting operation 804 includes applying a compressible thermally conductive material between the cooling tube and the source body.

Another assembly operation 806 assembles the modular gas distribution plates and gas baffle plates to the modular source body assembly. In one implementation, gas distribution and baffle plates are screwed to the source body assembly, and alignment pins are used to align the modules of the gas distribution plate along the length of the modular ion source. In addition, the gas distribution and baffle plate joints may be offset from the source body joints to provide added rigidity to the resulting modular ion source.

A mounting operation 808 mounts a gas entry manifold to the center joint in the ion source. In one implementation, only one (center) gas entry manifold is employed, although other implementations might use multiple gas entry manifolds along the length of the ion source. Another mounting operation 810 mounts a gas feeder manifold to each linear section module of the gas distribution plate. Another mounting operation 812 mounts an end manifold to each joint between an end module and a linear section module of the gas distribution plate. In one implementation, the manifolds are screwed to the gas distribution plate in these mounting operations.

An assembly operation 814 assembles the anode and insulator posts within the source body cavity. In one implementation, the insulator posts project through the gas baffle plate, the gas distribution plate and the gas manifolds, and are secured to the source body/gas distribution assembly by insulator nuts. A mounting operation 816 mounts the magnets and magnet covers along the length of the source body. Another mounting operation 818 mounts the cathode plates and the cathode covers to the source body and the magnet covers. The operations 814, 816, and 818 may also include adjustments to the height of the anode (e.g., via adjustable insulator posts) to set a uniform anode-cathode gap along the length of the ion source. A connecting operation 820 connects a gas intake line to the gas entry manifold (s). Another connecting operation 822 connects a cooling tube to the anode.

The above specification, examples and data provide a complete description of the structure and use of exemplary embodiments of the invention. Since many embodiments of the invention can be made without departing from the spirit and scope of the invention, the invention resides in the claims hereinafter appended.

Furthermore, certain operations in the methods described above must naturally precede others for the described method to function as described. However, the described methods are not limited to the order of operations described if such order sequence does not alter the functionality of the method. That is, it is recognized that some operations may be performed before or after other operations without departing from the scope and spirit of the claims.

What is claimed is:

1. A gas distribution system for an ion source having an anode, a cathode, and a source body forming a cavity containing the anode and supporting the cathode, the gas distribution system comprising:

a plurality of gas distribution plate modules forming a modular gas distribution plate for supplying a working gas to the ion source, each gas distribution plate module including a bifurcated distribution tree of gas distribution channels formed therein.

2. The gas distribution system of claim 1 wherein each gas distribution plate module further includes at least one supply channel, and further comprising:

at least one gas entry manifold mounted at a joint between at least two of the gas distribution plate modules to supply the working gas to the at least one supply channel of each gas distribution plate module.

3. The gas distribution system of claim 2 wherein the at least one gas entry manifold includes an adjustable valve that regulates the flow rate of the working gas into a gas distribution plate module.

4. The gas distribution system of claim 1 wherein each gas distribution plate module further includes at least one supply channel, and further comprising:

at least one gas feeder manifold mounted on one of the gas distribution plate modules to receive the working gas from the at least one supply channel of the gas distribution plate module.

5. The gas distribution system of claim 4 wherein the at least one gas feeder manifold is configured to supply the working gas received from the at least one supply channel of the gas distribution plate module to the bifurcated distribution tree of the gas distribution plate module.

6. The gas distribution system of claim 5 wherein the at least one gas feeder manifold includes an adjustable valve that regulates the flow rate of the working gas into the bifurcated distribution tree of the gas distribution plate module.

7. The gas distribution system of claim 1 further comprising:

at least one end gas distribution plate module positioned at a non-linear end section of the ion source to supply the working gas to the non-linear end section of the ion source.

8. The gas distribution system of claim 7 further comprising:

an end manifold mounted to the at least one end gas distribution plate module that receives the working gas via a supply channel of an adjacent gas distribution plate module and supplies the working gas to the at least one end gas distribution plate module.

9. The gas distribution system of claim 8 wherein the end manifold includes an adjustable valve that regulates the flow rate of the working gas into the at least one end gas distribution plate module.

10. The gas distribution system of claim 1 wherein the source body of the ion source comprises a plurality of source body modules.

11. The gas distribution system of claim 1 wherein each gas distribution plate module further includes a first supply channel spanning less than half the length of the gas distribution plate module and a second supply channel spanning more than half the length of the gas distribution module.

12. The gas distribution system of claim 1 further comprising:

a plurality of gas baffle plate modules forming a modular gas baffle plate for receiving the working gas from the modular gas distribution plate and supplying the working gas to the source body of the ion source.

13. The gas distribution system of claim 1 wherein the ion source is an anode layer source.

14. A method of assembling a gas distribution system of an ion source, the method comprising:

assembling a plurality of gas distribution plate modules into a gas distribution plate mounted to a source body of the ion source; and mounting a gas entry manifold at a joint between at least two of the gas distribution plate modules to distribute working gas to each of the distribution plate modules.

15. The method of claim 14 further comprising:

mounting a gas feeder manifold to at least one gas distribution plate module to feed the working gas into a channel of a bifurcated distribution tree in the at least one gas distribution module.

16. The method of claim 15 further comprising:

adjusting a valve connected to the gas feeder manifold to regulate the flow rate of the working gas into the bifurcated distribution tree.

17. The method of claim 14 wherein the assembling operation comprises:

assembling an end gas distribution plate module to at least one adjacent linear section gas distribution module.

18. The method of claim 17 further comprising:

mounting an end manifold at a joint formed by the end gas distribution plate module and the at least one adjacent linear section gas distribution module.

19. The method of claim 18 further comprising:

adjusting a valve connected to the end manifold to regulate the flow rate of the working gas into the end gas distribution plate module.

20. The method of claim 14 wherein the ion source is an anode layer source.

21. An ion source having an anode, a cathode, and a source body forming a cavity containing the anode and supporting the cathode, the ion source comprising:

a plurality of gas distribution plate modules forming a modular gas distribution plate for supplying a working gas to the ion source, each gas distribution plate module including a bifurcated distribution tree of gas distribution channels formed therein.

22. The ion source of claim 21 wherein the ion source is an anode layer source.

* * * * *